US007549312B2

(12) United States Patent
Huang

(10) Patent No.: US 7,549,312 B2
(45) Date of Patent: Jun. 23, 2009

(54) CONCENTRIC MACHINING DEVICE FOR A ROLLER

(76) Inventor: Te-Li Huang, No. 23-1, Ho-Shun Lane. Mei-Tzu Village, Feng-Shih Road, Shih-Kang Hsiang (TW) 442

( * ) Notice: Subject to any disclaimer, the term of this patent is extended or adjusted under 35 U.S.C. 154(b) by 290 days.

(21) Appl. No.: 11/279,740

(22) Filed: Apr. 13, 2006

(65) Prior Publication Data

US 2007/0243280 A1 Oct. 18, 2007

(51) Int. Cl.
*B21D 41/04* (2006.01)
*B21D 53/00* (2006.01)

(52) U.S. Cl. ..... 72/370.13; 72/297; 29/895

(58) Field of Classification Search ..... 72/370.1, 72/370.12, 370.13, 370.15, 370.11, 353.1, 72/355.2, 301, 302, 304, 308, 309, 317, 295, 72/296, 297; 29/895, 895.1, 895.3, 895.33
See application file for complete search history.

(56) References Cited

FOREIGN PATENT DOCUMENTS

JP 03165944 A * 7/1991

* cited by examiner

*Primary Examiner*—Dana Ross
*Assistant Examiner*—Debra M Sullivan

(57) ABSTRACT

A concentric machining device for a roller includes a movable upper base, a stationary lower base, two movable mold seats, two slide rods and four first hydraulic cylinders. Each of the mold seats has a forming mold inside, the forming mold has a fitting hole with an enlarged conical opening at the front side thereof, a locating shaft is received in the forming mold of the first mold seat and penetrates the fitting hole thereof and the first cylinder member, a clamping shaft is received in the forming mold of the second mold seat and penetrates the fitting hole thereof and the second hydraulic cylinder to connect with the fourth hydraulic cylinder. The roller is held by the bases and the shafts via two of the hydraulic cylinders and both ends of the roller are machined by the forming molds in the mold seats to provide squeezed and shrunk shapes once the mold seats are actuated by the other two hydraulic cylinders.

2 Claims, 5 Drawing Sheets

CONCENTRIC MACHINING DEVICE FOR A ROLLER

BACKGROUND OF THE INVENTION

1. Field of the Invention

The present invention is related to a hydraulic squeezing and shrinking machine for forming ends of a roller and particularly to a concentric machining device for ends of a roller.

2. Brief Description of Related Art

Referring to FIG. 1, a conventional machining and forming device for a roller usually provides a cylindrical blank roller 10 with a sufficient thickness available for being cut and worked. Then, the blank roller 10 is worked to provide a smooth outer surface with two conical ends 11 for a transmission belt such as a pedaling belt of a running machine moving on the roller 10 steadily without deviating leftward or rightward. The conical ends 11 are made a concentric bore as a journal 12 respectively with a lathe machine for a bearing 13 being mounted to the journal 12 such that the roller 10 is capable of turning smoothly. A spindle 14 is arranged in the center of the roller 10 to fit with the bearing 13 and is rotationally joined to an apparatus. In order to avoid vibration resulting from non-concentricity, correction for concentricity has to be performed before using. Usually, a correction point 15 is made by means of drilling a hole at the two ends 11 respectively for the roller 10 rotating with the spindle 14 concentrically.

However, there are following disadvantages while machining the preceding roller 10:

1. The journal 12 at the two ends 11 has to be machined individually such that twice works for clamping and unloading the roller 10 have to be done during machining.

2. Due to twice works for machining the journal 12 at the two ends 11 being done, it is time wasting and it is not easy to control precision of the coaxial line such that defective rate is high.

3. It is easy to hurt the outer surface of the roller 10 being clamped and unloaded several times.

4. The inner wall of the roller 10 is incapable of being lathe-worked except the two ends 11, it is incapable of obtaining a homogeneous thickness of the roller 10 and correction of concentricity leads to high production cost and difficult work such that experienced professional is required.

5. A sufficient thickness of the blank roller has to be retained for cutting and machining such that costs related to material, delivery and machining are hard to reduce substantially.

6. It is complicated to perform machining for the roller so that speed of machining is slow and more material has to be wasted.

Referring to FIGS. 2 and 3, Taiwanese Patent Application No. 90200678 is illustrated. A plurality of mold tools 20 with the same structure are arranged in a squeezing and forming machine and each of the mold tools 20 has a circular surface 23 at the center of the inner wall surface thereof. The diameter of the circular surface 23 is in accordance with the largest diameter of the roller. Both end sections of the respective mold tool 20 has a conical surface 22 next to the circular surface 23 and a concentric circular surface 22 respectively. Hence, when a steel pipe is inserted into the squeezing and forming machine for being formed as a finished roller 30, a conical surface 31 and a concentric journal part 32 at both ends thereof are made in accordance with the conical surface 22 and the concentric circular surface 21 at the same time. In this way, the roller 30 provides the identical concentricity at the outer surface and inner wall surface.

Further, a bearing 32 fits with the concentric journal part 32, which has been finished the surface thereof, so that the axial lines of the spindle 34 and the roller 30 coincide with each other to ensure the concentricity thereof.

The preceding prior art is capable of making the roller 30 with accurate concentricity of the outer and inner wall surfaces to overcome the deficiency of conventional way shown in FIG. 1.

SUMMARY OF THE INVENTION

The crux of the present invention resides in that a hydraulic actuated squeezing and forming machine is employed to improve the squeezing and forming machine disclosed in Taiwanese Patent Application No. 90200678 such that the inner and outer surfaces of the roller with two conical end sections and journal section for fitting with the bearing can be worked and finished at the same time for securing accurate concentricity of all parts of the roller.

An object of the present invention is to provide a concentric machining device with which a roller can be machined, squeezed and formed accurately at the same time to ensure concentricity of the entire roller.

Another object is to provide a concentric machining device with which a thinner steel pipe is employed as blank material for making a roller.

A further object is to provide a concentric machining device with which production rate of the roller can be promoted and precision for concentricity can be enhanced to 90% more than that made with the conventional way.

BRIEF DESCRIPTION OF THE DRAWINGS

The detail structure, the applied principle, the function and the effectiveness of the present invention can be more fully understood with reference to the following description and accompanying drawings, in which.

DETAILED DESCRIPTION OF THE PREFERRED EMBODIMENT

Figure 4:
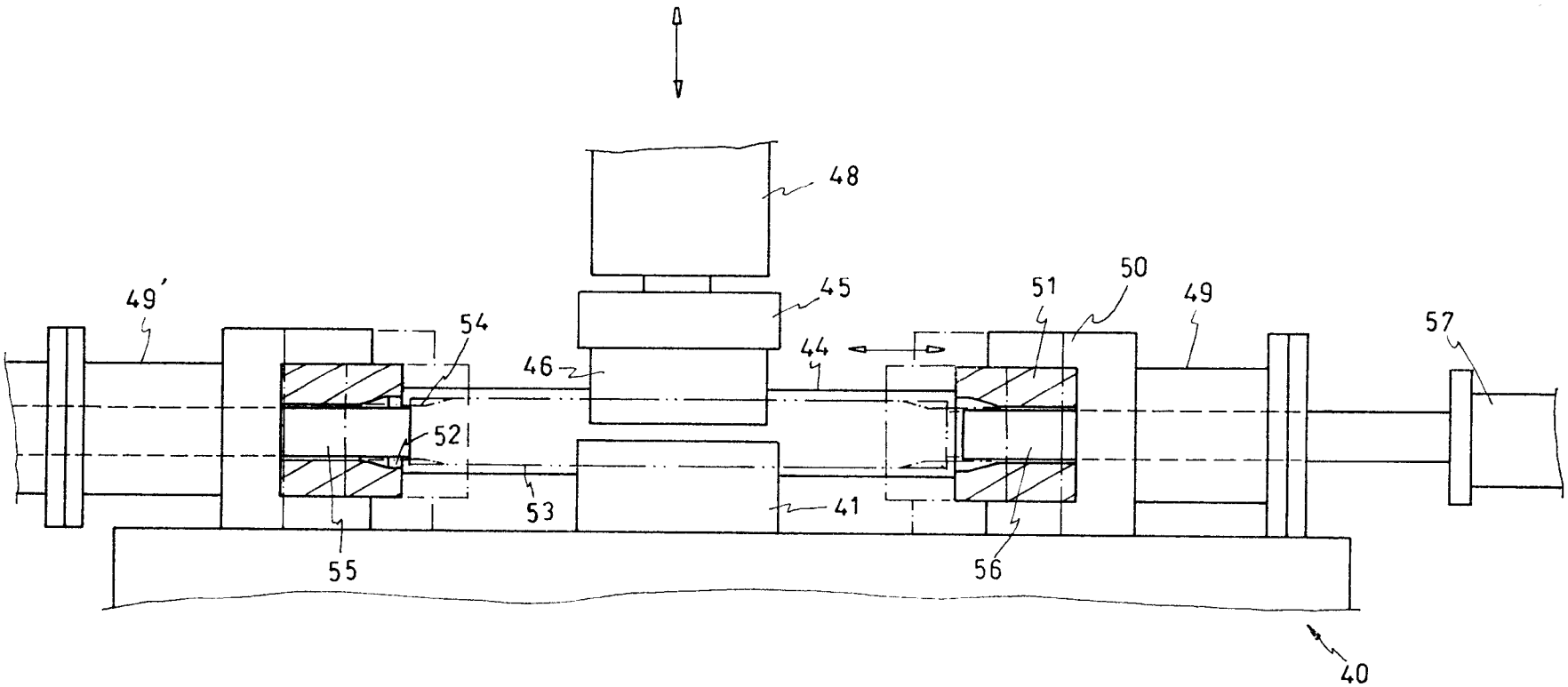
FIG. 4 is a plan view of a concentric machining device according to the present invention.
Figure 5:
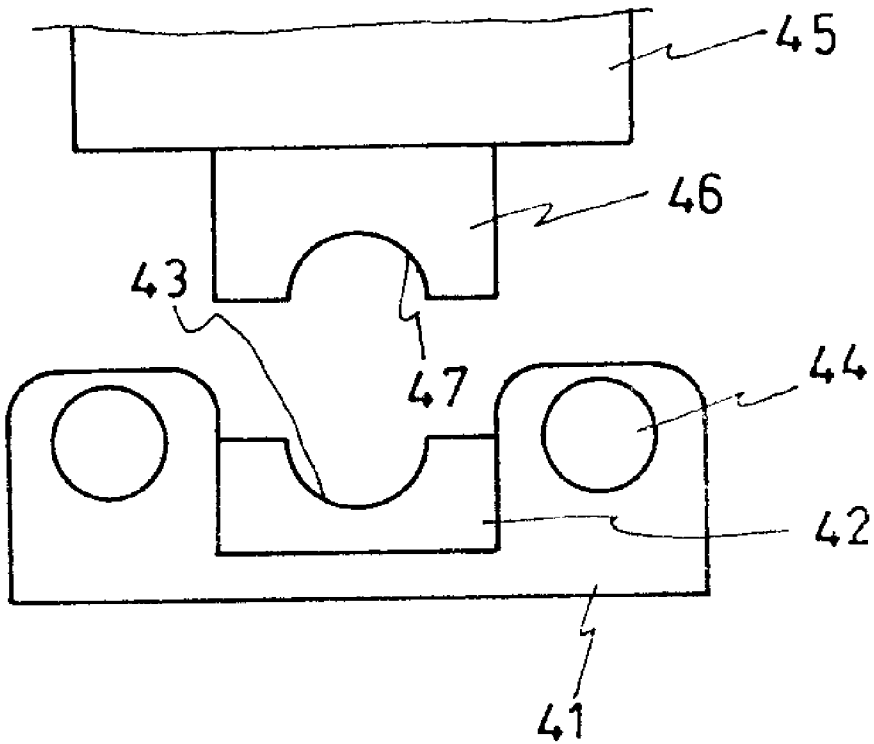
FIG. 5 is a fragmentary side view of FIG. 4.

Referring to FIGS. 4 and 5, a concentric machining device 40, which is associated with a squeezing and forming machine, according to the present invention provides a lower base 41 in which a lower mold 42 is received. The lower mold 42 has a lower locating recess 43. An upper base 45 is disposed to face the lower base 41 and an upper mold tool 46 with an upper locating recess 47 is attached to the bottom of the upper base 45. The lower locating recess 43 is opposite to the upper locating recess 47 for locating a roller 53, which is indicated with dash lines. The upper base 45 is fixedly attached to an end of a hydraulic cylinder 48 and is actuated by the hydraulic cylinder 48 to set the roller 53 in place tightly for both ends of the roller 53 being capable of being subjected to impacts while squeezing and forming work is performed. The lower base 41 at two lateral sides provides a guide rod 44 respectively next to the lower mold tool 42. Both ends of the respective guide rod 44 are connected to a mold seat 50 respectively and the two mold seats 50 are disposed oppositely and move along an axis the same as the axial line of the upper and lower bases 41, 45. A forming mold 51 with a fitting hole is received in the respective mold seat 50 and the fitting hole 62 has an enlarged taper mouth. A locating shaft 55 is provided in the fitting hole 52 of one of the mold seats 50 and a clamping shaft 56 is provided in the fitting hole 52 of another one of the mold seats 50. A hydraulic cylinder 49, 49' is joined to the rear side of the respective mold seat 50. The locating shaft 55 coincides with the axial line of the hydraulic cylinder 49' and is immobile and the clamping shaft 56 coincides with the axial line of the hydraulic cylinder 49 and extends rearward to connect with another hydraulic cylinder 57. The clamping shaft 56 is actuated to move by the hydraulic cylinder 57.

Figure 1:
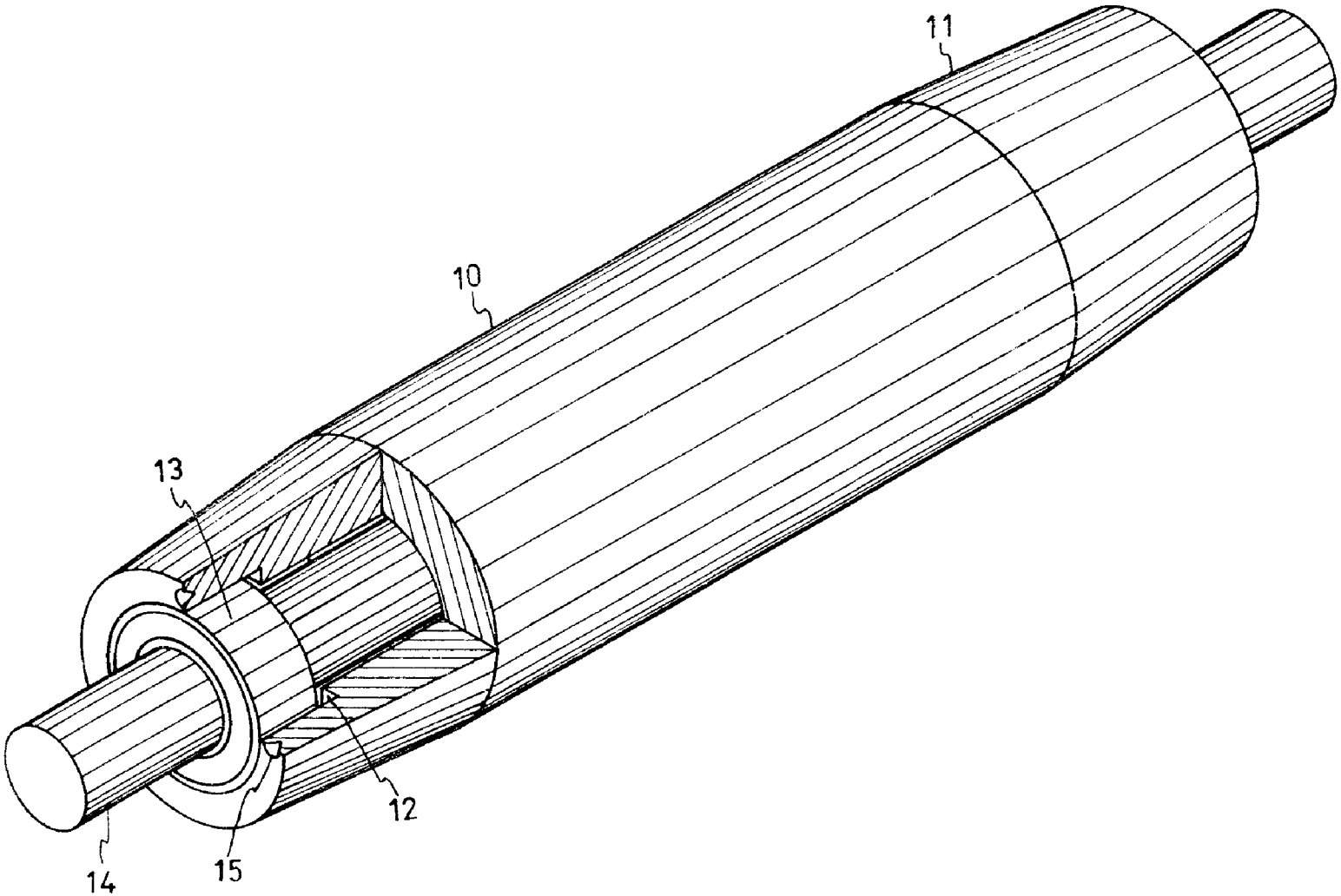
FIG 1 (Prior Art)
FIG. 1 is a perspective view of a conventional roller.
Figure 2:
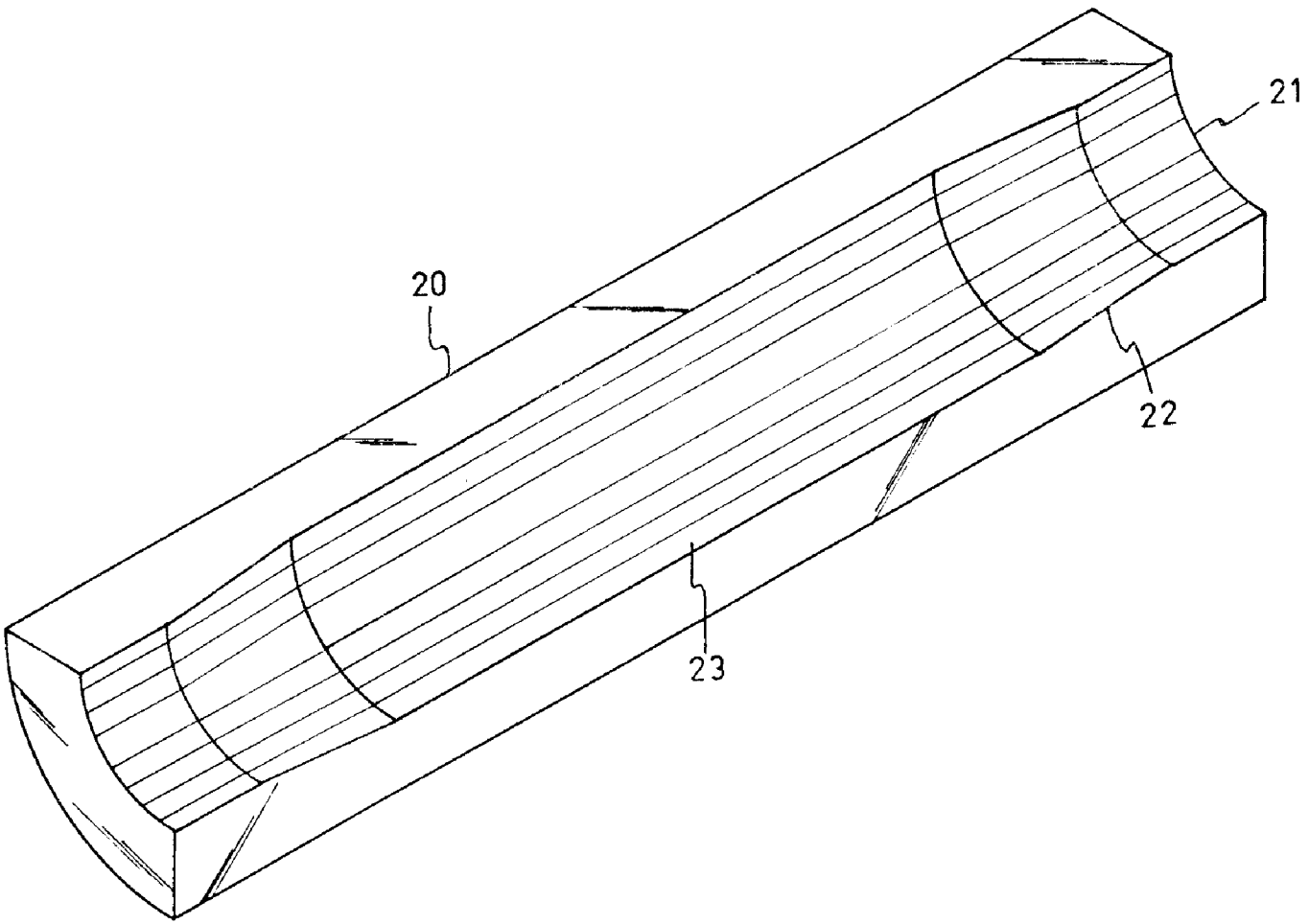
FIG 2 (Prior Art)
FIG. 2 is a perspective view of a mold tool disclosed in Taiwanese Utility Model Application No. 90200678.
Figure 3:
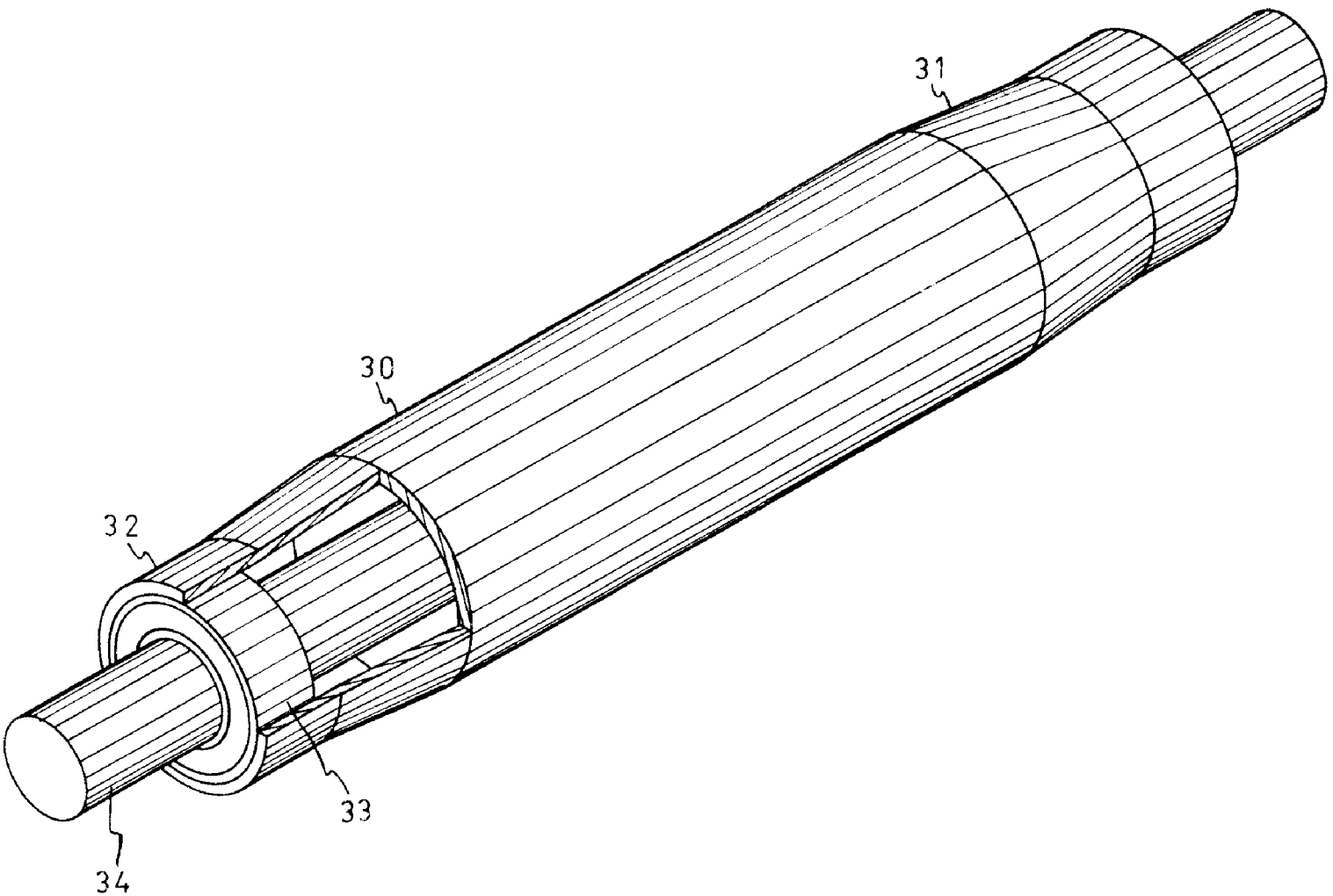
FIG 3 (Prior Art)
FIG. 3 is a perspective view of a roller made with a squeezing and forming machine disclosed in Taiwanese Utility Model Application No. 90200678.

When the roller 53 is placed on the lower locating recess 43 of the lower mold 42, an end of the roller 53 is pressed against the outer end of the locating shaft 55 and another end of the roller 53 is pressed with the clamping shaft 56, which is moved by the hydraulic cylinder 57 while the machine 40 is started. The hydraulic cylinder 48 actuates the upper base 45 to move downward at the same time such that the upper locating recess 47 is capable of pressing the roller 53 from top except the both ends of the roller 53 being pressed. Meanwhile, the mold seats 50 with the forming molds 51 are pushed to move forward along the guide rods 44 for the respective fitting hole 52 with enlarged taper opening thereof performing operation of squeezing and shrinking both ends of the roller 53 as a formed part 54 respectively before releasing the forming molds 51. Due to both ends of the roller 53 being held by the locating shaft 55 and the clamping shaft 56, it allows the forming molds 51 being capable of detaching from the roller 53 easily after both ends of the roller 53 being squeezed and shrank. Of course, right at this time, the hydraulic cylinders 48, 57 are moved backward with the upper mold 46 and the clamping shaft 56 respectively. Then, the worked roller 53 is arranged with bearings 33 and the spindle 34 inside to constitute a finished roller 30 as shown in FIG. 3.

It is appreciated that the roller worked by the concentric machining device of the present invention has the following advantages:

1. A thinner steel pipe can be employed as material of the roller such that weight of the roller is lowered and it is not necessary to perform machining the outer surface thereof for avoiding damage of material organization, lowering fabricating cost and increasing life span.

2. Due to the inner and outer diameters of the steel pipe providing the same concentricity, it is not necessary to correct the concentricity such that skilled technicians are not required for working the roller.

3. Due to providing accurate concentricity, the roller is capable of being used for high precision apparatus.

4. Due to the roller being made integrally, it is able to shorten fabricating time, promoting production quantity and enhancing precision.

While the invention has been described with referencing to a preferred embodiment thereof, it is to be understood that modifications or variations may be easily made without departing from the spirit of this invention, which is defined by the appended claims.

What is claimed is:

1. A concentric machining device for a roller comprising:

a movable upper base providing an upper mold inside;

a stationary lower base providing a lower mold inside opposite to the upper base;

a first and a second movable mold seats with the first mold seat being disposed near a lateral side of the lower base and the second mold seat being disposed near another lateral side of the lower base, and the two mold seats being arranged opposite to each other;

a first and a second slide rods being disposed between the lower base and the first mold seat and between the lower base and the second mold seat such that the mold seats are capable of sliding along the slide rods and are maintained in a concentric axial line during the machining of roller;

a first hydraulic cylinder being attached to the rear side of the first mold seat for moving the first mold seat;

a second hydraulic cylinder being attached to the rear side of the second mold seat for moving the second mold seat;

a third hydraulic cylinder being disposed on and connected to the upper base for moving the upper base;

a fourth hydraulic cylinder being disposed at the rear side of the second hydraulic cylinder;

wherein, each of the mold seats has a forming mold inside, the forming mold has a fitting hole with an enlarged conical opening at the front side thereof, a locating shaft is received in the forming mold of the first mold seat and penetrates the fitting hole thereof and the first cylinder member, a clamping shaft is received in the forming mold of the second mold seat and penetrates the fitting hole thereof and the second hydraulic cylinder to connect with the fourth hydraulic cylinder;

whereby, the roller is placed on the lower base with an end thereof keeping contact with the locating shaft and another end thereof being pressed with the clamping shaft, which is subjected to a pushing force from the fourth hydraulic cylinder, the roller is held by the upper base, which is moved by the third hydraulic cylinder, and both ends of the roller is machined by the forming molds at the same time to provide a squeezed and shrunk shapes once the mold seats are actuated to move forward by the first and second cylinders.

2. The concentric machining device as defined in claim 1, wherein the upper and lower molds each have a locating recess for holding the roller.

* * * * *